US010240391B2

(12) United States Patent
Watkins et al.

(10) Patent No.: US 10,240,391 B2
(45) Date of Patent: Mar. 26, 2019

(54) SWITCHING APPARATUS AND SYSTEM FOR WINDOW SHADINGS WITH POWERED ADJUSTMENT

(71) Applicant: Comfortex Window Fashions, Maplewood, NY (US)

(72) Inventors: Richard Watkins, Lake Luzerne, NY (US); Thomas Marusak, Loudonville, NY (US)

(73) Assignee: Comfortex Window Fashions, Maplewood, NY (US)

( * ) Notice: Subject to any disclaimer, the term of this patent is extended or adjusted under 35 U.S.C. 154(b) by 230 days.

(21) Appl. No.: 15/258,740

(22) Filed: Sep. 7, 2016

(65) Prior Publication Data

US 2017/0089133 A1 Mar. 30, 2017

Related U.S. Application Data

(60) Provisional application No. 62/232,112, filed on Sep. 24, 2015.

(51) Int. Cl.
*E06B 9/322* (2006.01)
*E06B 9/42* (2006.01)
(Continued)

(52) U.S. Cl.
CPC ..... *E06B 9/68* (2013.01); *E06B 9/32* (2013.01); *E06B 9/322* (2013.01); *E06B 9/42* (2013.01); *E06B 9/74* (2013.01); *H01H 36/02* (2013.01); *E06B 2009/3222* (2013.01); *E06B 2009/6809* (2013.01); *E06B 2009/689* (2013.01)

(58) Field of Classification Search
USPC ..... 160/DIG. 16
See application file for complete search history.

(56) References Cited

U.S. PATENT DOCUMENTS 3,489,971 A * 1/1970 Robert ..... H01H 36/0026 335/207
4,991,350 A 2/1991 Kirk
(Continued)

FOREIGN PATENT DOCUMENTS

DE 3545149 A1 * 8/1987 ..... H01H 36/00
DE 19605273 A1 8/1997
(Continued)

*Primary Examiner* — Robert Canfield
(74) *Attorney, Agent, or Firm* — Hoffman Warnick LLC

(57) ABSTRACT

Embodiments of the present disclosure include a switching apparatus for a powered adjustment system of a window shading, wherein said switching apparatus includes: a magnetically actuated switch positioned externally to the powered adjustment system and having an on position and an off position, wherein said magnetically actuated switch actuates a drive mechanism of the powered adjustment system in the on position, the drive mechanism being configured to adjust a position of the window shading; and an alignment feature positioned on a housing for the window shading proximal to said magnetically actuated switch, said alignment feature being configured to position a magnet of a switching tool outside the housing to control the powered adjustment system by actuating said magnetically actuated switch between the on position and the off position.

20 Claims, 12 Drawing Sheets

(51) Int. Cl.

| | |
|---|---|
| ***E06B 9/68*** | (2006.01) |
| ***H01H 36/02*** | (2006.01) |
| ***E06B 9/74*** | (2006.01) |
| ***E06B 9/32*** | (2006.01) |

(56) References Cited

U.S. PATENT DOCUMENTS 5,179,602 A * 1/1993 Norcross, Jr. ..... G02B 6/3572 200/47
7,504,598 B2 * 3/2009 Weigold ..... H03K 17/97 200/61.45 M
8,910,695 B2 12/2014 Knight
2001/0050538 A1 * 12/2001 Kovach ..... E06B 9/32 318/16
2003/0145957 A1 * 8/2003 Domel ..... E06B 9/32 160/168.1 R
2004/0160296 A1 * 8/2004 Gilmore ..... H01H 36/0006 335/207
2006/0238281 A1 * 10/2006 Steinberg ..... H01H 36/0013 335/207
2007/0257625 A1 * 11/2007 Brison ..... G08C 17/00 315/291
2010/0018654 A1 * 1/2010 Skinner ..... E06B 9/322 160/84.02
2014/0184367 A1 * 7/2014 Liao ..... H03K 17/9502 335/205
2015/0334790 A1 * 11/2015 Scapa ..... H05B 33/08 315/294
2016/0369557 A1 * 12/2016 Vandermillen ..... E06B 9/70
2017/0167193 A1 * 6/2017 Slivka ..... E06B 9/72

FOREIGN PATENT DOCUMENTS

| | | | |
|---|---|---|---|
| DE | 19938632 A1 | | 2/2001 |
| JP | 64-40916 | * | 2/1989 |
| JP | 2005-285612 A | * | 3/2004 |
| WO | 2010076820 A1 | | 7/2010 |

* cited by examiner

SWITCHING APPARATUS AND SYSTEM FOR WINDOW SHADINGS WITH POWERED ADJUSTMENT

BACKGROUND

1. Technical Field

The disclosure relates generally to devices for switching powered adjustment systems for window shadings. More particularly, the present disclosure relates to a switching apparatus and switching tool for use with powered adjustment systems of window shadings, such as those for motor-driven window shadings activated and deactivated with an electrically-powered system.

2. Background Art

In operation, a window shading may include an adjustment mechanism (e.g., a roller, spool assembly, etc.) that is positioned within, mounted to, and/or otherwise mechanically coupled to a shade housing, also known simply as a housing, in a conventional manner. One housing can be designed to accommodate multiple types of shadings, including single-fabric shadings, fabric venetian-style window shadings, etc. Some window shadings (e.g., roller, cellular, pleated, or fabric-venetian) are operated by a cord system. Cord systems can include a cord lock with a pull cord through the shading, or a loop cord through a clutch and roller at the top of the shade. Cord systems may be operable to adjust a position of the window shading and/or hold the window shading in a desired position relative to the roller. Cord systems traditionally rely only on mechanical elements, without external power sources.

Manufacturers and merchants of window shade assemblies have increasingly considered powered (e.g., motorized) actuation systems to replace cords. Many powered systems for window shadings have been proposed. In one scenario, all cords can be eliminated, e.g., by motorizing the movement of a window shading to provide variable positions and transparency. In some cases, a motorized shade can additionally provide mechanisms for remote control and/or timer-driven deployment. In other cases, these motors may be driven by a control panel or switch(es) positioned directly on an outer surface of the housing to provide a variety of functions.

Powered actuation systems for window shadings have proven difficult to access from a remote location. For example, fundamental hardware components for providing electrical power and/or driving the actuation of a shade are frequently positioned within a housing for the roller of the window shading. Many windows extend to an upper surface beyond the reach of a typical user, thereby impeding access to devices for manipulating the powered actuation of the shading. Conventional devices may seek to address this problem by including special-purpose tools or for accessing the housing above the window, which may be associated with additional costs. Remote-controlled window shadings may be possible, but also require additional elements to be housed in portions of the window shading and/or require the use of additional or sometimes unwieldy components. In addition, remote-controlled systems may be associated with other design concerns, e.g., the cost of complexity of digital logic for reducing drain on the battery. Drain on the battery may be especially pronounced in remote-controlled systems because of a need for the system to continuously determine whether an operating signal has been transmitted to the system from a user.

In addition to the above-noted challenges, restructuring a window shading assembly to include switches, buttons, motors, remote access tools, etc., for a motorized adjustment system may increase design and manufacturing costs. Such issues may be of greater concern where a manufacturer and/or merchant desires for switches or control panels to provide multiple functions while being accessible to a large number of consumers, and at reasonable cost. Conventional approaches may also negatively affect the design of a motorized window shading, and may cause motorized window shadings to exhibit substantially higher costs relative to cord-based products.

SUMMARY

A first aspect of the present disclosure provides a switching apparatus for a powered adjustment system of a window shading, wherein said switching apparatus includes: a magnetically actuated switch positioned externally to the powered adjustment system and having an on position and an off position, wherein said magnetically actuated switch actuates a drive mechanism of the powered adjustment system in the on position, the drive mechanism being configured to adjust a position of the window shading; and an alignment feature positioned on a housing for the window shading proximal to said magnetically actuated switch, said alignment feature being configured to position a magnet of a switching tool outside the housing to control the powered adjustment system by actuating said magnetically actuated switch between the on position and the off position.

A second aspect of the present disclosure provides a window shading system including: a powered adjustment system for a window shading, the powered adjustment system being mechanically coupled to a housing assembly, said powered adjustment system including a drive mechanism configured to adjust position of the window shading; a magnetically actuated switch positioned externally to said powered adjustment system and operatively coupled thereto, said magnetically actuated switch having an on position and an off position, such that said magnetically actuated switch selectively enables operation of said drive mechanism; and an alignment feature positioned on the housing assembly for the window shading proximal to said magnetically actuated switch, said alignment feature being configured to position a magnet of a switching tool outside the housing assembly to control the powered adjustment system by actuating said magnetically actuated switch between the on position and the off position.

A third aspect of the present disclosure provides a system including: a rotatable member positioned within a housing; a shading element mechanically coupled to said rotatable member such that rotation of said rotatable member adjusts a position of said shading element relative to an architectural opening; a drive mechanism mechanically coupled to said rotatable member to drive rotation thereof; a switch positioned externally to said drive mechanism and operably coupled thereto, wherein said switch being actuated to an on position enables operation of said drive mechanism, and wherein a cover visually conceals a position of said switch; and an alignment feature positioned on the cover and proximal to said switch.

The illustrative aspects of the present disclosure are designed to solve the problems herein described and/or other problems not discussed.

BRIEF DESCRIPTION OF THE DRAWINGS

These and other features of the present disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Embodiments of the present disclosure provide various features for operating a powered adjustment system of a window shading, e.g., embodiments of a switching apparatus and systems for operating a window shading which include embodiments of a switching apparatus and/or switching tool therein. As used herein, a "window shade powered adjustment system" generally refers to a window shade in which the mechanical operation of a window shade, e.g., unfurling and retraction of the window shade, is aided in part by one or more powered mechanisms. A powered mechanism, as used herein, can include one or more of an electric motor, a pneumatic actuator, a hydraulic actuator, and/or any other currently known or later developed device for providing power to a mechanical system, and which can be selectively activated or deactivated using an input device such as a switch. A switch, as used herein, can include any currently-known or later developed form of device for making or breaking a connection in an electric circuit. Embodiments of the present disclosure may include magnetically actuated switches.

A "magnetically actuated switch" can refer to any currently-known or later-developed electrical switch which moves between an "on" (e.g., closed circuit) position and an "off" (e.g., open circuit) position by the action of magnetic flux, and in particular can include reed switches, or similar magnetically actuated elements such as a Hall Effect sensor, a magnetic actuator, etc. A Hall Effect sensor refers to an electrical transducer which outputs a higher electrical voltage when in the proximity of a magnet. A magnetic actuator refers to a component which converts an electromagnetic input into a mechanical output, e.g., to extend or retract an electrically conductive component to form or break an electrical connection between two components. In alternative embodiments, the "on" position may correspond with an open circuit while the "off" position may correspond with a closed circuit.

Figure 1:
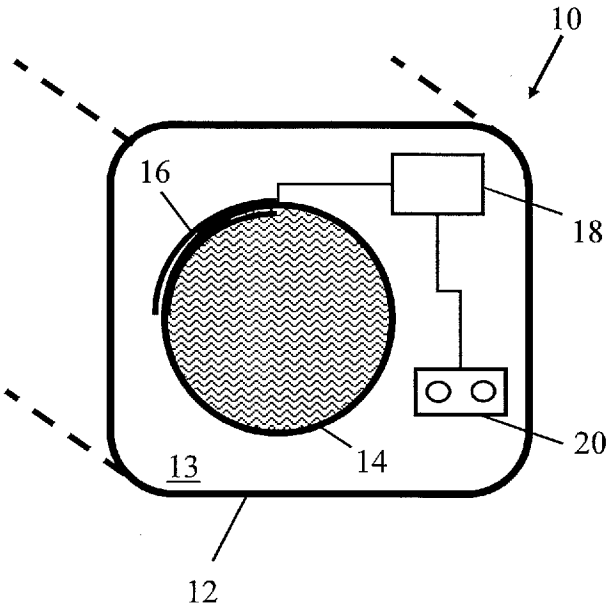
FIG. 1 shows a schematic view of a window shading with a powered adjustment system according to embodiments of the present disclosure.

Referring to FIG. 1, a partial perspective view of a window shading system ("system") 10 according to embodiments of the present disclosure is shown. System 10 can include a housing 12 for physically protecting and/or visually obscuring operative elements therein. In particular, housing 12 include a hollow interior 13 adapted to include components such as a drive mechanism 14 for unfurling and/or retracting one or more window shading(s) ("shading" or "shadings") 16, which may include one or more fabric sheets. Although drive mechanism 14 of system 10 is shown by example to be in the form of a single horizontally-extending roller for directly receiving shading 16 thereon, other embodiments are contemplated. For instance, drive mechanism 14 may be provided in the form of a shaft-mounted spool for winding and unwinding a cord (not shown) coupled to shading 16, e.g., as may be applicable to cellular shading systems. Other currently-known or later-developed forms of drive mechanism 14 may be used or adapted for use in system 10 and in embodiments of the present disclosure. Although only one drive mechanism 14 is shown by example in FIG. 1, it is understood that various alternative embodiments can provide for any conceivable number of drive mechanisms, e.g., two rollers, five rollers, ten rollers, one spool, two spools, ten spools, combinations of spools and rollers and/or other mechanisms, etc.

A window shading powered adjustment system ("adjustment system") 18 can mechanically operate drive mechanism(s) 14 based on inputs provided through a switch ("switch") 20. Adjustment system 18 can include, e.g., a mechanically and/or electrically driven motor system which may include conventional components for generating and/or imparting a force to operate drive mechanism(s) 14. In an example, adjustment system 18 can include an electric motor, a mechanical and/or electrical transmission for converting between electrical and mechanical force, rotary and/or linear couplings, etc. A basic form of adjustment system 18, more particularly, can include an electric motor coupled to a power supply, discussed elsewhere herein, and configured to transmit electrical signals and impart mechanical forces to operate drive mechanism(s) 14 by way of one or more conventional transmissions (e.g., gears, belts, and/or other mechanical transmission devices) between a motor and drive mechanism(s) 14.

Switch 20, in a generic form, can allow users and/or other devices to enable or disable movement of drive mechanism 14 by adjustment system 18. Embodiments of the present disclosure can relate to switches 20 with magnetic materials, which may be controlled by way of various devices and/or methods described herein. Adjustment system 18 can be mechanically coupled to drive mechanism 14 to provide a driving force for rotating drive mechanism 14, and can be in communication with switch 20 by way of any currently known or later developed connection, e.g., wireless data couplings, wire-based electrical connections, and/or other conventional elements for relaying electrical signals between components.

Figure 2:
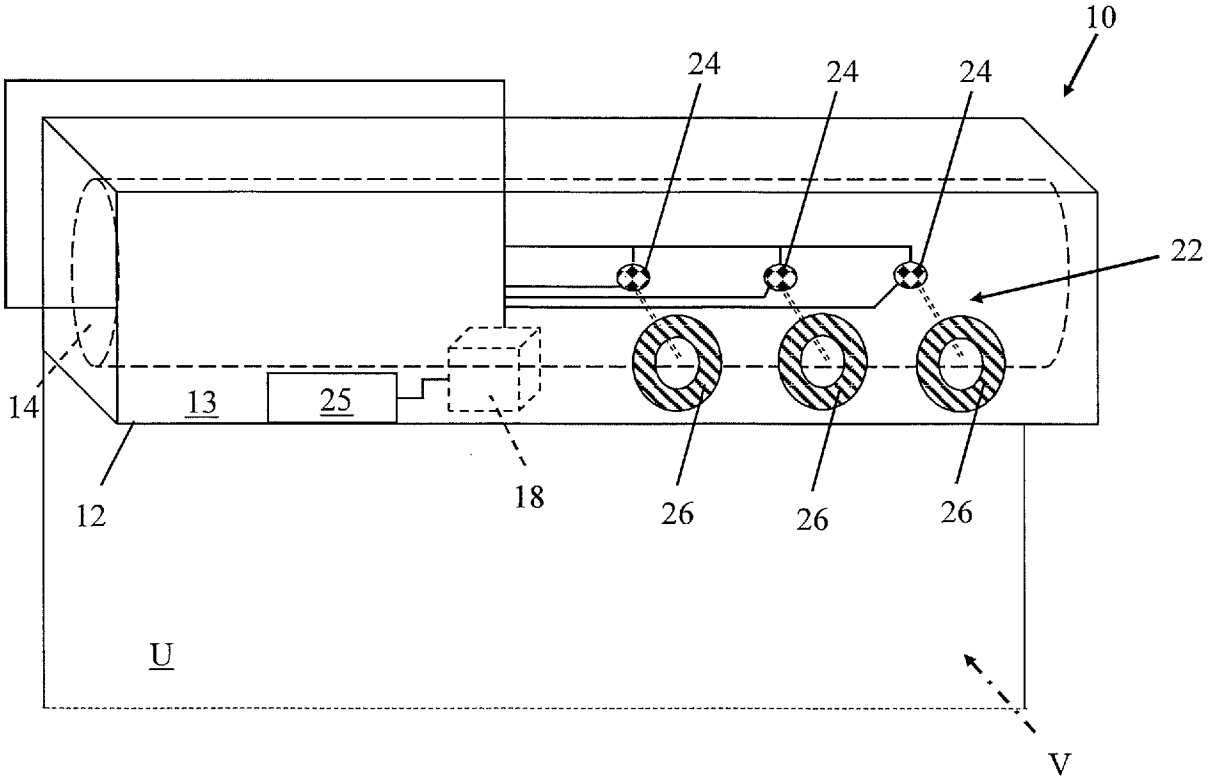
FIG. 2 shows a perspective view of a housing and switching apparatus according to embodiments of the present disclosure.

Turning to FIG. 2, an embodiment of system 10 with a switching apparatus 22 according to embodiments of the present disclosure is shown. System 10 may be positioned proximal to (e.g., directly in front of) an architectural opening U, such as a window and/or other architectural feature for providing a line of sight to a viewer. Shading 16 of system 10 may selectively obstruct and or block a user's ability to see through architectural opening U, e.g., in the direction of view line V. Some or all of switching apparatus 22 can be visually concealed from an observer of system 10 looking in the direction of view line V. For instance, switching apparatus 22 may be located within hollow interior 13 of housing 12. In other embodiments described herein, switching apparatus 22 may be positioned outside housing 12 yet may be concealed from a user's line of sight, e.g., by being positioned behind one or more other elements of system 10 without being within hollow interior 13. Regardless of the selected location, switching apparatus 22 may be physically external to and/or independent from drive mechanism 14 and/or actuation system 18, such that elements of switching apparatus 22 do not interfere with electrical and/or magnetic elements of other portions of system 10.

However embodied, switching apparatus 22 may be operable to control the operation of drive mechanism 14 by way of one or more magnetically actuated switches 24, each of which may be visually concealed by other elements of system 10, or in some cases may be positioned within hollow interior 13 of housing 12. Although magnetically actuated switches 24 are described by example herein, it is understood that embodiments of the present disclosure may operate by way of other types of switches (e.g., mechanically, electrically, and/or other non-magnetically actuated switches). Each magnetically actuated switch 24 may be electrically coupled between adjustment system 18 and drive mechanism 14, and may be in an "off" position when at rest. That is, each magnetically actuated switch 24 may be configured such that electrical signals do not travel from adjustment system 18 to drive mechanism 14 to adjust drive mechanism 14 and shading 16 while system 10 is not being manipulated by a user, e.g., through one or more tools described elsewhere herein. By being operably connected between adjustment system 18 and drive mechanism 14, each magnetically actuated switch 24 can adjust a position of shading 16, e.g., by being moved to an "on" position with one or more magnetic materials and/or components described elsewhere herein.

In various embodiments, magnetically actuated switches 24 may control electrical signals and/or currents related to features other than the underlying power source to system 10 and actuation system 18. Actuation system 18 may include or otherwise be connected to a power supply 25 (e.g., a battery, connection to an external power source, etc.) which is independent from magnetically actuated switches 24. Here, electrical power may be constantly provided by power supply 26 to actuation system 18 regardless of whether magnetically actuated switches 24 are turned on or off, allowing one or more electrical functions to be executed independently from the operation of system 10 and/or switching apparatus 22. Each magnetically actuated switch 24 can thereby control the transmission of electrical signals between drive mechanism 14 and actuation system 18 to adjust the position of shading 16. Such arrangements may omit the requirement or use of independent power sources for each magnetically actuated switch 24 in switching apparatus 22.

Embodiments of system 10 can also allow actuation system 18 to be selectively operated by transmitting signals thereto from switching apparatus 22, without constantly scanning for inputs from other devices (e.g., remote controls). The location of switching apparatus 22 outside drive mechanism 14 and actuation system 18, in addition, can prevent a user from causing magnetic interference with drive mechanism 14, actuation system 18, and/or other elements of system 10. A separation distance between switching apparatus 22 and drive mechanism 14 and/or actuation system 18 can be sufficient to prevent magnetic flux from affecting internal components of drive mechanism 14, actuation system 18, and/or other components of system 10 as magnetically actuated switches 24 are used. According to one embodiment, a separation distance between drive mechanism 14 and magnetically actuated switches 24 of switching apparatus may be, e.g., approximately 0.15 meters.

Switching apparatus 22 can include one or more alignment features 26 positioned on housing 12, and proximal to respective magnetically actuated switches 24. Alignment features 26 can include any physical fixture, visual indicator, etc., positioned on housing 12 to identify the position of magnetically actuated switches 24 concealed from the view of a user, e.g., by being positioned inside housing 12 or on exterior surfaces hidden from view by other structures. Elements which are "visually concealed" or simply "concealed," as discussed herein, are not visible to the naked eye of a human who observes system 10 and architectural opening U together, e.g., from substantially the direction of view line V. A visually obscured element may simultaneously include one or more visual portions and one or more non-visible portions such that only part of the element is concealed to an observer. In some cases, a manufacturer of system 10 may visually conceal an element by completely hiding the element from the view of a user (e.g., by positioning the element within or behind other elements), or may hide only a certain percentage (e.g., one-quarter, one-half, three-quarters, ninety percent, etc.) of the element's exterior surface area from the view of a user. Other forms of visual concealment (e.g., camouflaged shapes and/or texturing) may also be used to visually conceal an element which would otherwise be visible when system 10 is observed in the direction of view line V.

As described elsewhere herein, each alignment feature 26 can be configured to position one or more external magnets (e.g., within a switching tool) at predetermined locations outside housing 12 to control actuation system 18. Alignment features 26 can thus identify locations where a magnet will actuate corresponding magnetically actuated switches 24 between on and off positions. Drive mechanism 14, actuation system 18, magnetically actuated switches 24, and/or power supply 25, can together define portions of a distinct electric circuit in switching apparatus 22. Alignment feature(s) 26 can include or be embodied as visual indicators (e.g., different colored, shaped, and/or other visually distinct elements) positioned on housing 12 for identifying the position at which a magnet may actuate magnetically actuated switches 24 between off and on positions. Alignment features 26 may thus be structurally integral with the structure and composition of housing 12, and more specifically can be distinguished from the remainder of housing 12 solely by having distinct visual characteristics (e.g., different colors, patterning, etc.).

Figure 3:
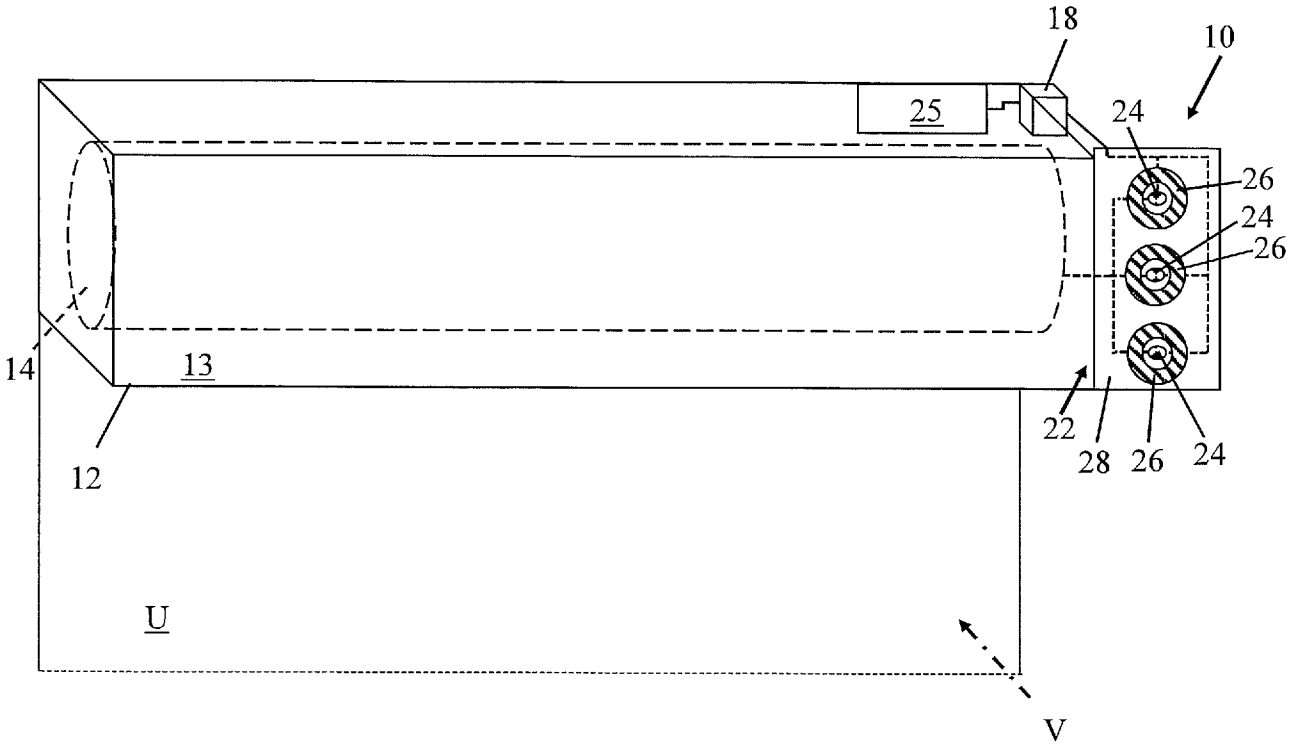
FIG. 3 shows a perspective view of a housing and switching apparatus according to further embodiments of the present disclosure.

Turning to FIG. 3 an embodiment of system 10 is shown to demonstrate alternative arrangements of switching apparatus 22 relative to housing 12. A cover 28 may be mechanically coupled to housing 12, yet may be embodied as a distinct structural component, e.g., a plate, a headrail, a separate housing, and/or any other functional or ornamental component of a window shading. However embodied, cover 28 may be positioned outside hollow interior 13 of housing 12 and in some cases may extend outwardly therefrom, e.g., in one or more lateral directions. Cover 28 may form part of, or may be structurally integrated with, the remainder of housing 12. In other embodiments, cover 28 may be structurally independent from housing 12 and may be mechanically coupled to elements of system 10 besides housing 12 (e.g., drive mechanism 14, actuation system 18, sidewalls of architectural opening U, etc.). Cover 28, in addition, may be composed of a translucent or opaque material for obstructing a viewer's ability to see magnetically actuated switches 24 positioned behind cover 28, e.g., from the direction of view line V. As shown, actuation system 18 may be electrically coupled to power supply 25 and drive mechanism 14. However, actuation system 18 itself may also be positioned outside hollow interior 13 of housing 12. Actuation system 18 may be electrically coupled to drive mechanism 14 of system 10 in addition to magnetically actuated switches 24 and/or other components of switching apparatus 22.

According to an embodiment, magnetically actuated switches 24 may be positioned behind cover 28 and mechanically coupled thereto. Thus, magnetically actuated switches 24 and/or other components of switching apparatus 22 may be concealed from the view of a user observing system 10 in the direction of view line V. Switching apparatus 22 may thus be visually concealed (e.g., partially, mostly, or completely hidden) from the view of a user despite being positioned outside hollow interior 13 of housing 12. Alignment features 26, in addition, may be positioned on cover 28 to identify locations proximal to each magnetically actuated switch 24, such that an operator of system 10 may adjust the position of magnetically actuated switches 24 despite not being able to see magnetically actuated switches 24 through cover 28. As discussed elsewhere herein, each alignment feature may be embodied as a visually distinct region relative to the remainder of cover 28 and/or visible portions of housing 12.

Figure 4:
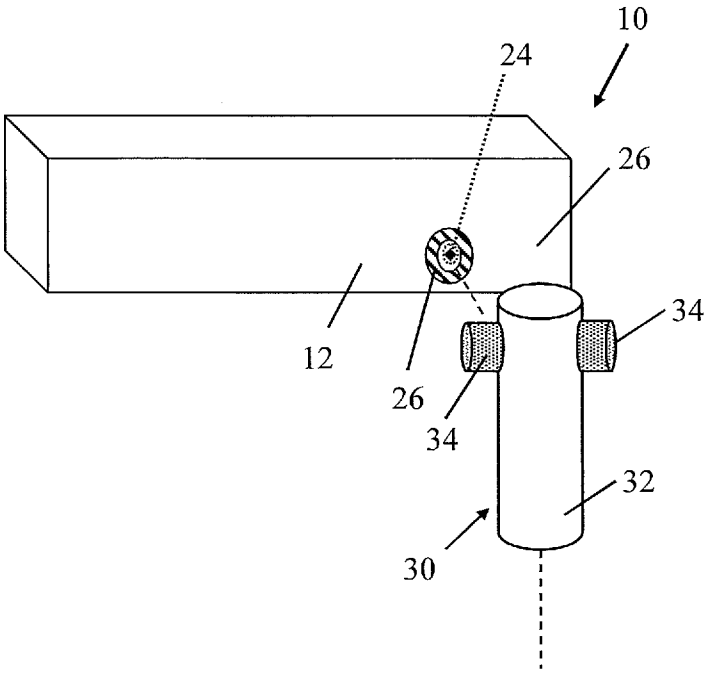
FIG. 4 shows a perspective view of a switching tool positioned outside a housing for a window shading and accompanying switching apparatus according to embodiments of the present disclosure.

Referring to FIG. 4, embodiments of the present disclosure can be configured to interact with, and/or may include a switching tool 30 for interacting with magnetically actuated switch 24 (shown in phantom to denote placement inside housing 12). FIG. 4 illustrates an embodiment of system 10 with only one magnetically actuated switch, for the sake of comparison to alternative embodiments with several magnetically actuated switches. Switching tool 30 may, in a simplified form, include an elongate member 32 with one or more magnets 34 (provided, e.g., in the form of a radially-extending arm including a magnetic material therein) extending outwardly therefrom. Although embodiments of elongate member 32 with two magnets 34 are described herein by example, it is understood that switching tool 30 can alternatively include a single magnet 34 or more than two magnets 34.

Elongate member 32 can be in the form of any conceivable mechanical instrument for providing physical displacement in one or more directions. According to an example, elongate member 32 may include a shaft, a beam, a pole, a wand, etc., which may extend linearly, curvi-linearly, and/or in any combination of linear or curvi-linear directions to provide a desired displacement. Elongate member 32 can be sized to have any conceivable length to accommodate and permit access to magnetically actuated switches 24 by a user. Thus, elongate member 32 is depicted partially in phantom with broken lines to illustrate the possibility of alternative embodiments.

Each magnet 34 may at least partially include a magnetic metal as described elsewhere herein, e.g., one or more magnets, electromagnets, programmable magnets, etc., which transmit a field of magnetic flux and may be operable to manipulate ferrous metals. As shown in FIG. 4, a separation distance between magnets 34 of switching tool 30 may, if desirable, be substantially equal to a separation distance between adjacent alignment features 26 on housing 12. In this way, switching tool 30 can alternatively and/or simultaneously position magnets 34 proximal to two or more alignment features 26 for respective magnetically actuated switches 24.

Figure 5:
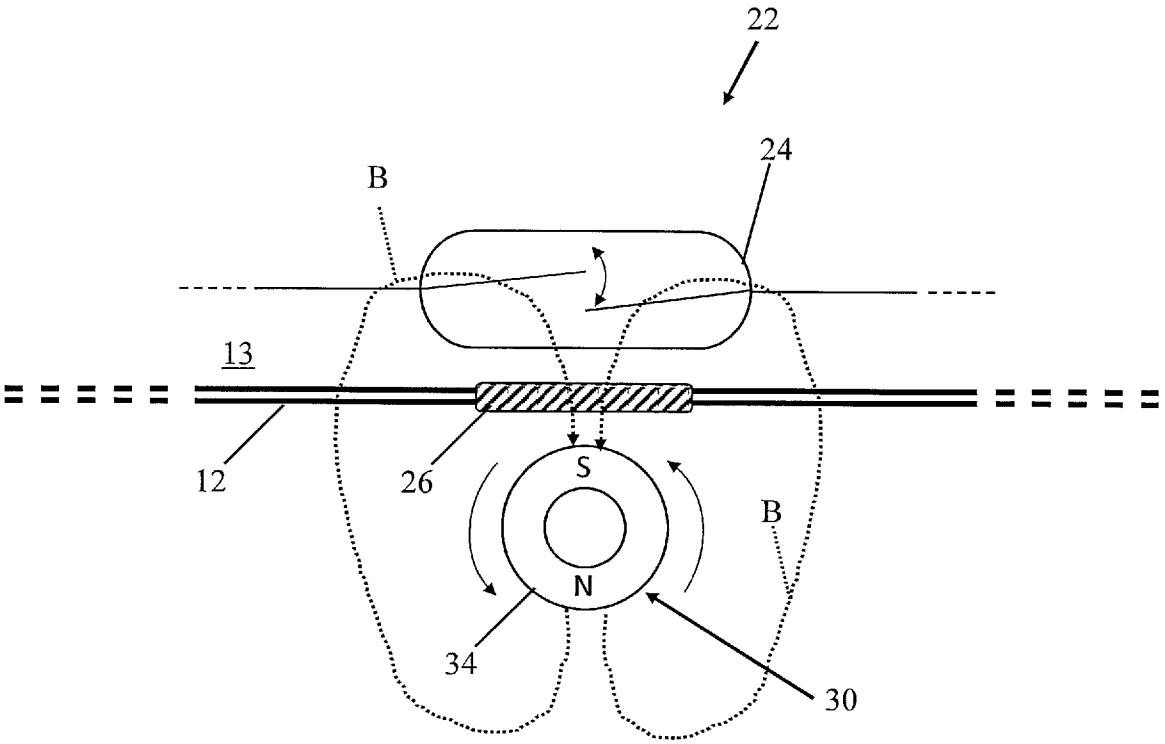
FIG. 5 shows a schematic view of a switching tool and magnetically actuated switch according to embodiments of the present disclosure.

Turning to FIG. 5, a cross-section of magnet 34 and magnetically actuated switch 24 is shown to demonstrate various operations implemented with switching apparatus 22 in embodiments of the present disclosure. In an embodiment, magnetically actuated switch 24 can include a reed switch initially biased into an "off" position (e.g., current travel therethrough is prevented), but capable of being actuated into an "on" position when subjected to a magnetic field. According to one example, magnetically actuated switch 24 can be composed of a ferrous material and/or other metals which move in response to magnetic fields, e.g., two ferrous wires in physical proximity but not in contact with each other.

Magnet 34 of switching tool 30 may be positioned proximal to alignment feature 26 at the exterior surface of housing 12 such that a magnetic field B includes lines of flux extending from the north pole ("N") of magnet 34 through magnetically actuated switch 24 and into the south pole ("S") of magnet 34. In this manner, magnet(s) 34 of switching tool 30 can control drive mechanism 14, e.g., by actuating magnetically actuated switches 24 between "on" and "off" positions. As illustrated in FIG. 5, switching tool 30 can actuate magnetically actuated switch 24 without contacting housing 12 and/or alignment feature 26. Although magnetically actuated switch 24 being in an "on" position generally corresponds to a closed electrical circuit in the examples described herein, it is understood that this may be reversed in alternative scenarios. For example, actuation system 18 may include one or more logic circuits which associate a current flow through magnetically actuated switch(es) 24 with "on" or "off" states. In such implementations, each magnetically actuated switch 24 need not directly control a flow of electrical power to drive mechanism 14, but instead may control the flow of electrical signals to actuation system 18 that controls other components configured to selectively control drive mechanism 14. Such circuitry of actuation system 18 can be manipulated or defined such that an "on" corresponds to an open circuit across actuated switch(es) 24. Likewise, a user may define the "off" position to correspond to a closed circuit across magnetically actuated switch(es) 24.

The underlying magnetic field strength of each magnet 34 may be sufficient to cause actuation of magnetically actuated switch 24 without contacting housing 12 with magnet(s) 34 and/or other portions of switching tool 30. In an example, magnetically actuated switch may be configured to switch to an "on" position when subjected to a magnetic field strength with a flux density of at least approximately one-thousand Gauss (G), which may be produced by magnets 34 having a magnetic field having a maximum flux density of, e.g., approximately five-thousand G.

To prevent interference with the operation of switching apparatus 22, housing 12 and/or alignment feature 26 may be composed of a material which does not significantly impede the passage of magnetic flux therethrough, and according to one example may be composed of one or more non-ferrous metals, plastics, ceramic materials, etc., with a thickness sufficient for negligent impedance of magnetic field B. In this case, the lack of interference from housing 12 on magnetic field B may permit housing 12 to be manufactured without apertures (e.g., holes, openings, etc.) between its exterior surface and hollow interior. Switching device 22 can thereby operate solely by the use of magnets 34 and/or other magnetic materials, without the need for buttons or other actuation devices positioned on housing 12. The orientation of magnetic field B may be adjusted by movement and reorientation of magnet 34 as illustrated by the accompanying arrows of rotation. Where magnet 34 includes an electromagnetic, programmable magnet, etc., it is understood that the positions of each pole (N, S) therein may be changed, adjusted, etc., for use with magnetically actuated switches 24 at particular positions within housing 12.

Figure 6:
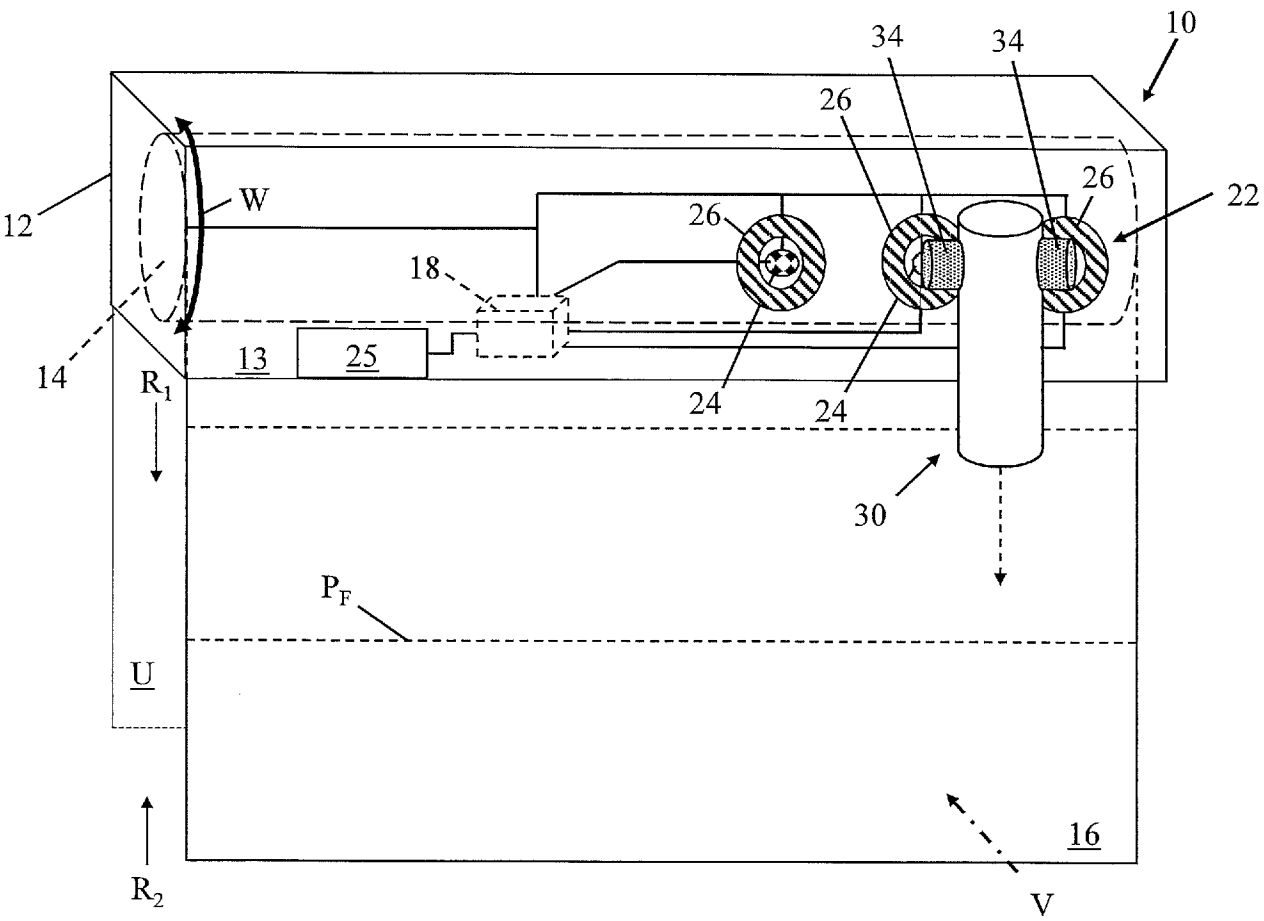
FIG. 6 shows a perspective view of a system being used to operate a powered adjustment system for a window shading according to embodiments of the present disclosure.
Figure 7:
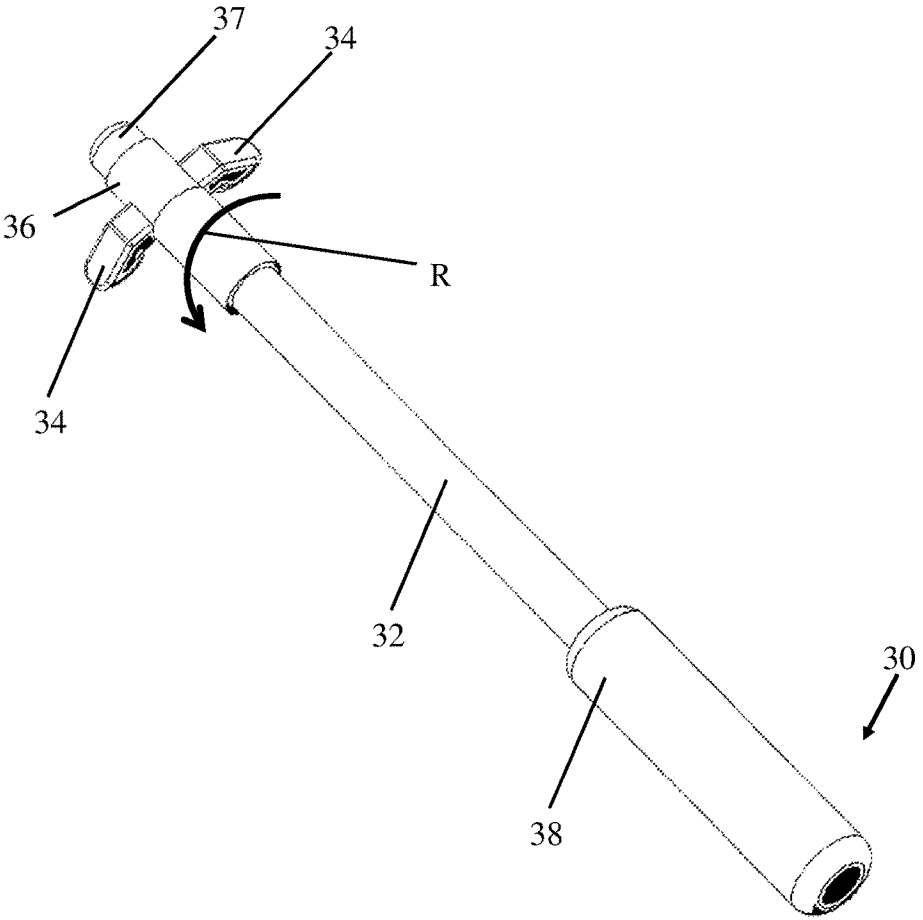
FIG. 7 shows a perspective view of a switching tool according to embodiments of the present disclosure.

Referring to FIGS. 2 and 7 together, embodiments of system 10 and switching apparatus 22 are shown to demonstrate an example operation of the various embodiments described herein. Shading 16 is shown by example in FIG. 6 to be in a fully unrolled position, and other positions are also illustrated by way of phantom lines. Magnetically actuated switches 24 are shown in FIG. 6 solely for clarity of illustration, and it is understood that each magnetically actuated switch 24 can be located within hollow interior 13 of housing 12 as described elsewhere herein. To adjust the position of drive mechanism 14, switching tool 30 can be positioned proximal to alignment features 26 and corresponding magnetically actuated switches 24 of switching apparatus 22. System 10 and/or switching apparatus 22 includes several magnetically actuated switches 24 positioned within hollow interior 13 of housing 12, each operatively coupled to actuation system 18 and drive mechanism 14.

Each magnetically actuated switch 24 can be configured to enable one of several operations of drive mechanism 14 and corresponding adjustments of shading 16. Magnetically actuated switch(es) 24 can control rotational movement of drive mechanism 14 along line W to provide a corresponding adjustment of shading 16. For example, as depicted in FIG. 6, a fully or partially retracted shading 16 can be lowered when magnet 34 is positioned proximal to magnetically actuated switch 24 and alignment feature 26. In particular, shading 16 can move in direction of $R_1$ after switching tool 30 is positioned proximal to a predetermined magnetically actuated switch 24 (e.g., the rightmost positioned magnetically actuated switch 24 on housing 12). Where shading 16 is fully or partially unrolled from drive mechanism 14, magnet 34 of switching tool 30 can be positioned proximal to another magnetically actuated switch 24 (e.g., the horizontally middle magnetically actuated switch 24 on housing 12) to move shading 16 upwards in the direction of arrow $R_2$. Switching apparatus 22 can allow a user to define one or more favored positions $P_F$ of shading 16, and move shading 16 into favored positions $P_F$ from other positions. To implement this feature, one or more magnetically actuated switches 24 can program the current position of shading 16 as a favored position, e.g., within a memory component of adjustment system 18 where applicable. In an embodiment, a user may position switching tool 30 proximal to a predetermined magnetically actuated switch 24 (e.g., the leftmost magnetically actuated switch 24 on housing 12) to define a favored position $P_F$. Thereafter, a user may activate the same magnetically actuated switch 24 (e.g., with switching tool 30) or a different magnetically actuated switch 24 to move shading 16 into position $P_F$ from a different position. The favored positions entered by a user can be erased, overwritten, and/or modified by actuating with other magnetically actuated switches 24.

The operation of defining favored position $P_F$ and moving to favored position $P_F$ may be delegated to multiple magnetically actuated switches 24. In still other embodiments, defining and/or moving to favored positions may be achieved by actuating multiple magnetically actuated switches 24 simultaneously. In this case, two or more magnetically actuated switches 24 can perform an additional function when actuated together, distinct from any individual functions performed when each magnetically actuated switch 24 is actuated individually. For example, switching tool 30 can include two or more magnets 34 extending from elongate member 32 in different directions. A separation distance between each magnet 34 may be substantially equal to a separation distance between adjacent magnetically actuated switches 24. Switching tools 30 which include this feature can thereby allow two or more adjacent magnetically actuated switches 24 to be actuated simultaneously. It is therefore understood that switching apparatus 22 can be configured to perform additional operations contingent on actuating multiple magnetically actuated switches 24 simultaneously, e.g., with several magnets 34 of switching tool 30. For example, moving two magnets 34 proximal to two magnetically actuated switches 24 simultaneously can define a favored position $P_F$ for shading 16, while actuating a different, single magnetically actuated switch 24 with one magnet 34 of switching tool 30 can move shading 16 to the favored position $P_F$ previously defined by a user.

Turning to FIG. 7, an embodiment of switching tool 30 is shown. Switching tool 30 can be operable to actuate magnetically actuated switches 24 (FIGS. 2-6) of switching apparatus 22 (FIGS. 2-3, 5-6). Switching tool 30 can include elongate member 32 that extends in any desired direction, e.g., linearly, curvi-linearly, etc. A rocking member 36 can engage a surface shaped to receive rocking member 36 to provide rotational movement of switching tool 30 relative to other components. A retaining member 37 of switching device 30 can physically engage a mechanically coupling or contact surface as described elsewhere herein, and optionally can obstruct lateral or vertical movement of switching tool 30 during operation. Elongate member 32 can extend substantially axially from rocking member 36 to end at a grip 38 of switching tool 30, and in some cases may be configured for extensibility and/or retraction (e.g., telescoping members) such that switching tool 30 has an adjustable length. A user can move switching tool 30 with grip 38 to thereby position rocking member 36 and magnets 34.

Rocking member 36 can also define an element to which magnet(s) 34 of switching tool 30 are coupled. Although rocking member 36 is shown by example as being in the form of a separate structure relative to elongate member 32, alternative embodiments are possible. Rocking member 36 can be coupled axially to elongate member 32 to provide at least partial rotational movement of switching tool 30. At least one magnet 34 can extend radially outward from rocking member 36. In addition to extending radially outward from elongate member 32, magnet(s) 34 can also extend toward housing 12 (FIGS. 1-6) to provide closer proximity between switching tool 30 and magnetically actuated switches 24. Magnet(s) 34 can be moved closer to and/or away from magnetically actuated switch(es) 24, e.g., by rocking member 36 being rotated in a predetermined direction. Rotational movement of switching tool 30 can proceed substantially in the forward or reverse direction of arrow R.

Figure 8:
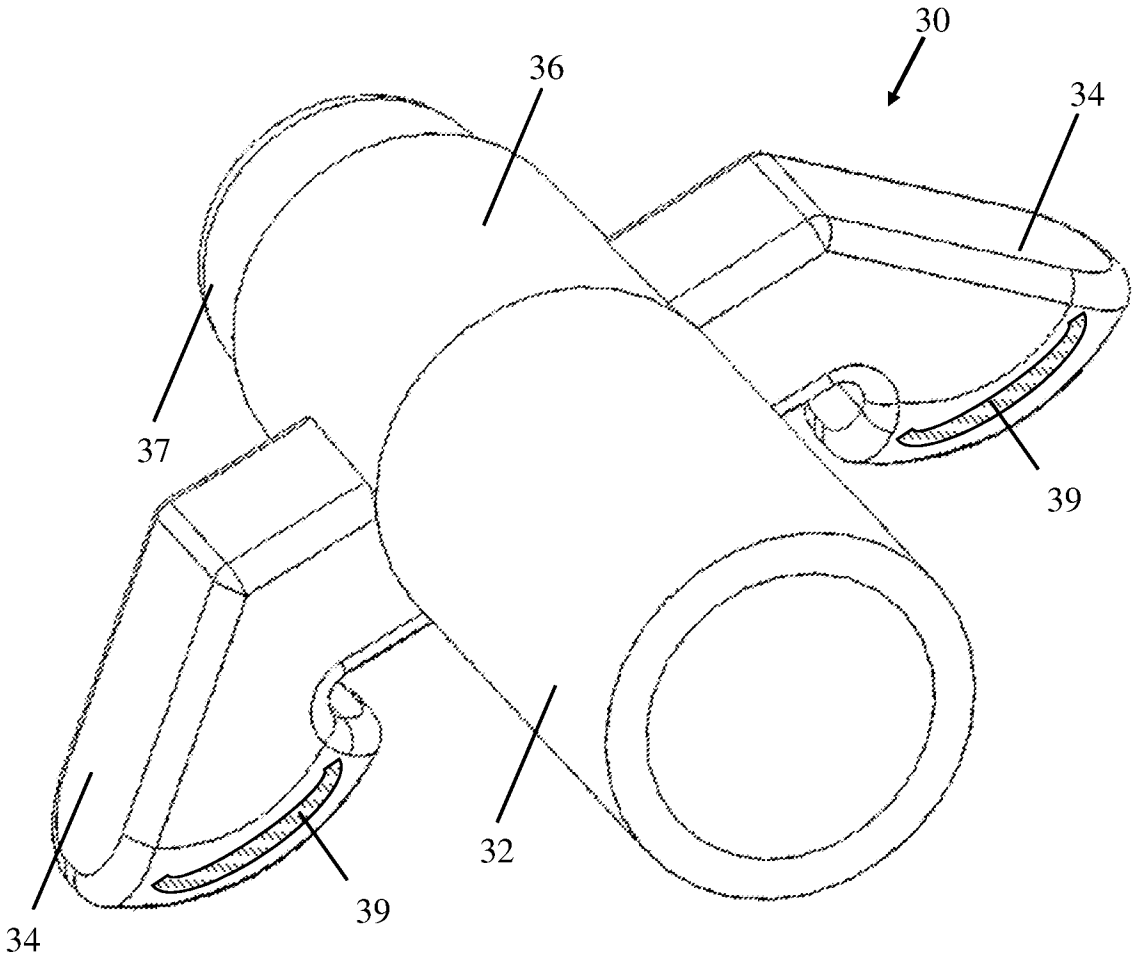
FIG. 8 shows an enlarged, partial perspective view of a switching tool according to embodiments of the present disclosure.

Turning to FIG. 8, portions of switching tool 30 are shown in a magnified view to further illustrate features thereof. Switching tool 30 can be structured for use with system 10 (FIGS. 1-6) and/or switching apparatus 22 (FIGS. 2-6). As discussed above, switching tool 30 can include rocking member 36 for engaging complementary surfaces and/or defining an axis of rotation for switching tool 30. Each magnet 34 can include at least one embedded magnet 39 therein composed of, e.g., one or more magnetized materials for producing magnetic field B (FIG. 5). In addition, embedded magnet(s) 39 can serve to attract or repel one or more magnetic materials within magnetically actuated switches 24 of switching apparatus 22, proximal to alignment feature(s) 26 to control switching apparatus 22. Magnet(s) 34 can extend radially outward from rocking member 36 and can be configured (and, optionally shaped) to actuate magnetically actuated switches 24 of switching apparatus 22. Magnets 34 can, optionally, be shaped to include a rounded profile to better align magnetic fields B produced by embedded magnet(s) 39 therein with components of switching apparatus 22, e.g., alignment feature(s) 26 (FIGS. 2-6).

Figure 9:
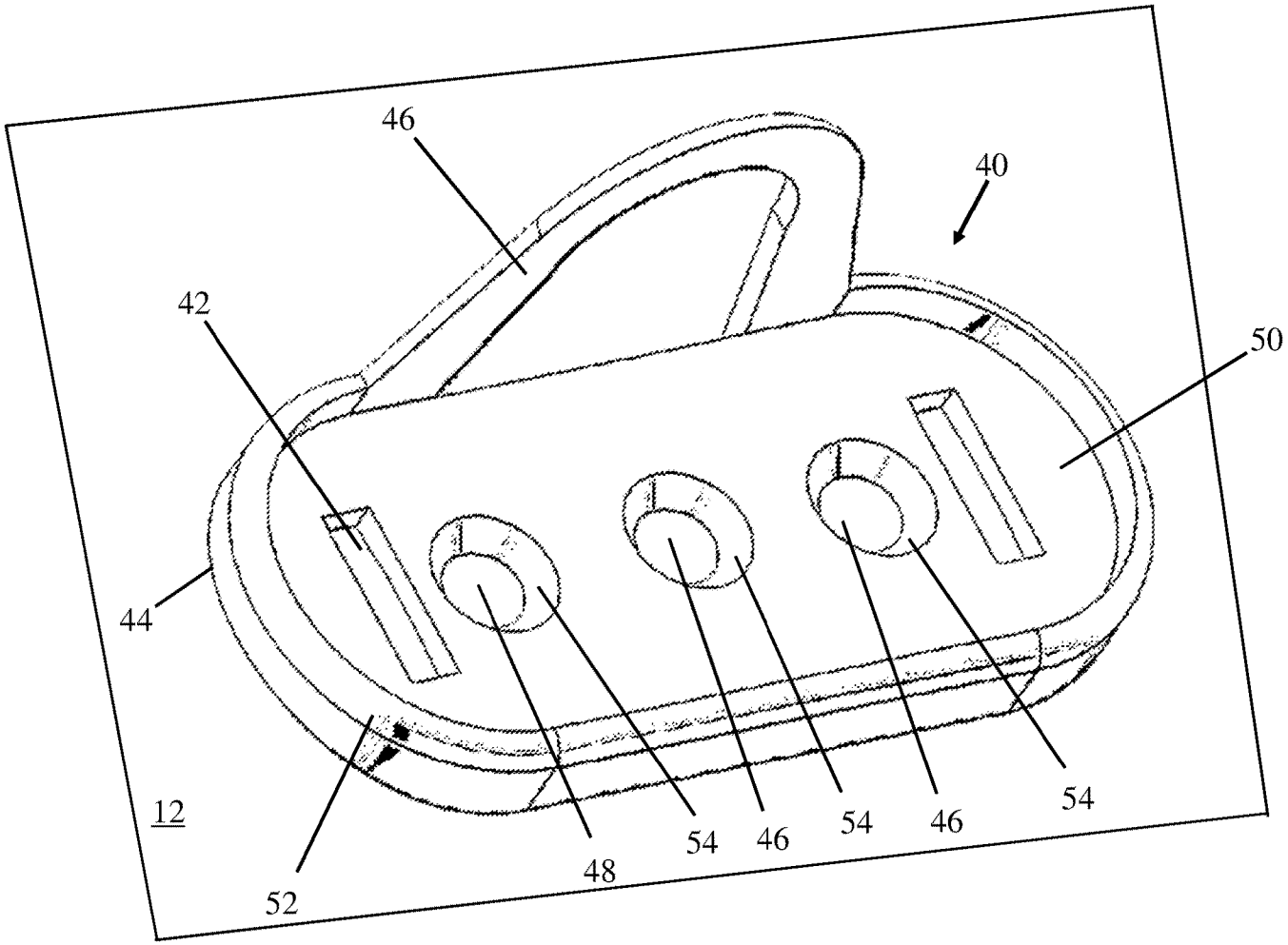
FIG. 9 shows a perspective view of a retention device for a switching tool according to embodiments of the present disclosure.

Turning to FIG. 9, system 10 and/or switching apparatus 22 can also include retention features for engaging switching tool 30 (FIGS. 4-8) to housing 12 and/or receiving switching tools 30 thereon. In one embodiment, a retention device 40 may include at least one slot 42 extending through a base 44, such that a pin, hook, rivet, and/or other retaining fixture coupled to housing 12 can maintain retention device in a fixed position. Retention device 40 can also include a seat 46 for engaging a corresponding portion of switching tool 30, e.g., retaining member 37 (FIGS. 7-8) thereon. Seat 46 can be provided in the form of any currently known or later developed mechanical fixture for matingly engaging a corresponding element, e.g., a hollow slot, tube, and/or frame for receiving a rod, protrusion, or coupling fixture of an external device such as switching tool 30. Seat 46 can at least permit rotational movement of switching tool 30 therein. In some embodiments, seat 46 can selectively prohibit translational movement of a switching tool by the use of retractable pins, stoppers, etc., and more specifically can obstruct or prevent further vertical movement of switching tools 30 engaged to seat 46. Although seat 46 is shown in a closed, substantially "U-shaped" form, it is understood that seat 46 can be provided in other shapes, e.g., a substantially crescent-shaped form, a substantially "V-shaped" form, etc.

Retention device 40 can optionally include additional structural elements pertaining to interaction between switching apparatus 22 (FIGS. 2-6) and switching tool 30. Base 42 of retention device 40 can include, e.g., one or more guide apertures ("apertures") 48 extending from the exterior surface of housing 12 to an outer surface 50 of base 42. Aperture(s) 48 can expose alignment feature(s) 26 positioned on housing 12 and inboard of base 42, such that retention device may be mounted on housing 12 without blocking alignment features 26. Retention device can also include, e.g., a rim 52, positioned adjacent to an edge of base 42. Rim 52 can protrude at least partially from outer surface 50 of base 42 to obstruct lateral movement of a switching tool across outer surface 50 of retention device 40. Rim 52 can thereby prevent or impede switching tool 30 (FIGS. 4-8) from slipping away from switching apparatus 22 and retention device 40 during operation.

In an embodiment, retention device 40 can optionally include additional features for guiding switching tool 30 (FIGS. 4-8) toward alignment feature(s) 26 of switching apparatus 22 (FIGS. 2-6). To aid the movement of switching arm(s) 34 (FIGS. 4-8) toward magnetically actuated switch(es) 24, aperture(s) 48 can include an interior 54 shaped in, e.g., a substantially frusto-conical fashion as that depicted in FIG. 9. In addition or alternatively, interior 54 of aperture(s) 48 can be provided in other shapes such as, e.g., an elongated frusto-conical shape, a decreasingly contoured shape relative to outer surface 50, a substantially hemispherical shape, a chamfered configuration, and/or a countersunk profile. Regardless of the particular shape used, a cross-sectional area of aperture(s) 48 proximal to outer surface 50 can be greater than a cross-sectional area of aperture(s) 48 proximal to housing 12. The shape of aperture(s) 48 at interior 54 can thereby mechanically guide switching tool 30 from the outside of retention device 40 toward magnetically actuated switch(es) 24. In embodiments where switching apparatus 22 includes multiple magnetically actuated switches 24, each magnetically actuated switch 24 can be substantially aligned with a respective aperture 48 having a shape and variable cross-section for guiding switching tool 30 as discussed herein.

Figure 10:
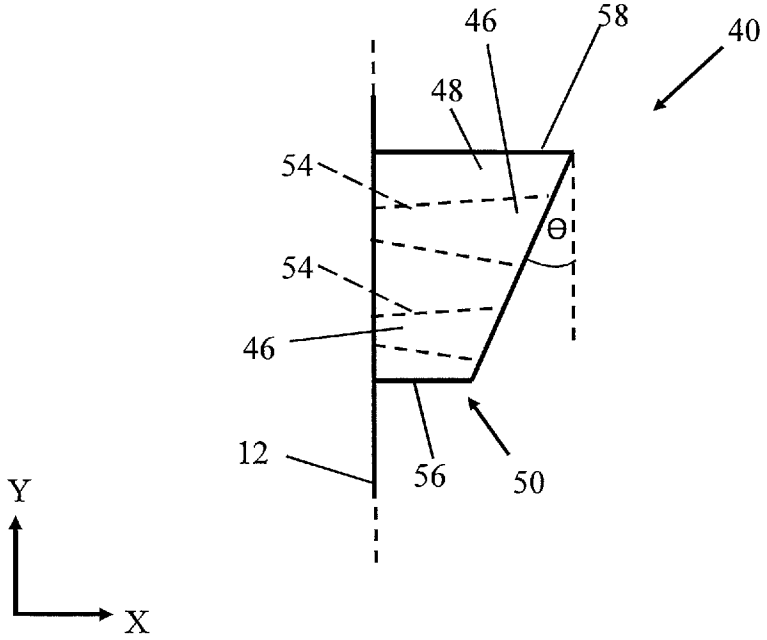
FIG. 10 shows a cross-sectional view of a retention device according to embodiments of the present disclosure.

Turning briefly to FIG. 10, retention device 40 can be designed to provide a distinct angular orientation of outer surface 50 relative to the exterior of housing 12. A first end 56 (e.g., a lower end along vertical axis Y) of base 42 can have a smaller length dimension than an opposing second end 58 (e.g., an upper end along vertical axis Y), such that outer face has an angular orientation Θ relative to horizontal axis X. As a result, outer surface 50 of base 42 can have a different angular orientation from an exterior surface of housing 12. In an embodiment, the exterior surface of housing 12 where base 42 is coupled can extend substantially in parallel with vertical axis Y, while outer surface 50 of base 24 can extend vertically and at least partially horizontally. The resulting angular orientation Θ of outer surface 50 can provide, e.g., re-vectoring of movement against base 42 and thereby facilitate the movement of switching tool 30 (FIGS. 4-8) horizontally toward aperture(s) 46, despite a user being positioned vertically distal to retention device 40. In a particular example, the value of angular orientation Θ can be between approximately 15° and approximately 60° relative to housing 12.

Figure 11:
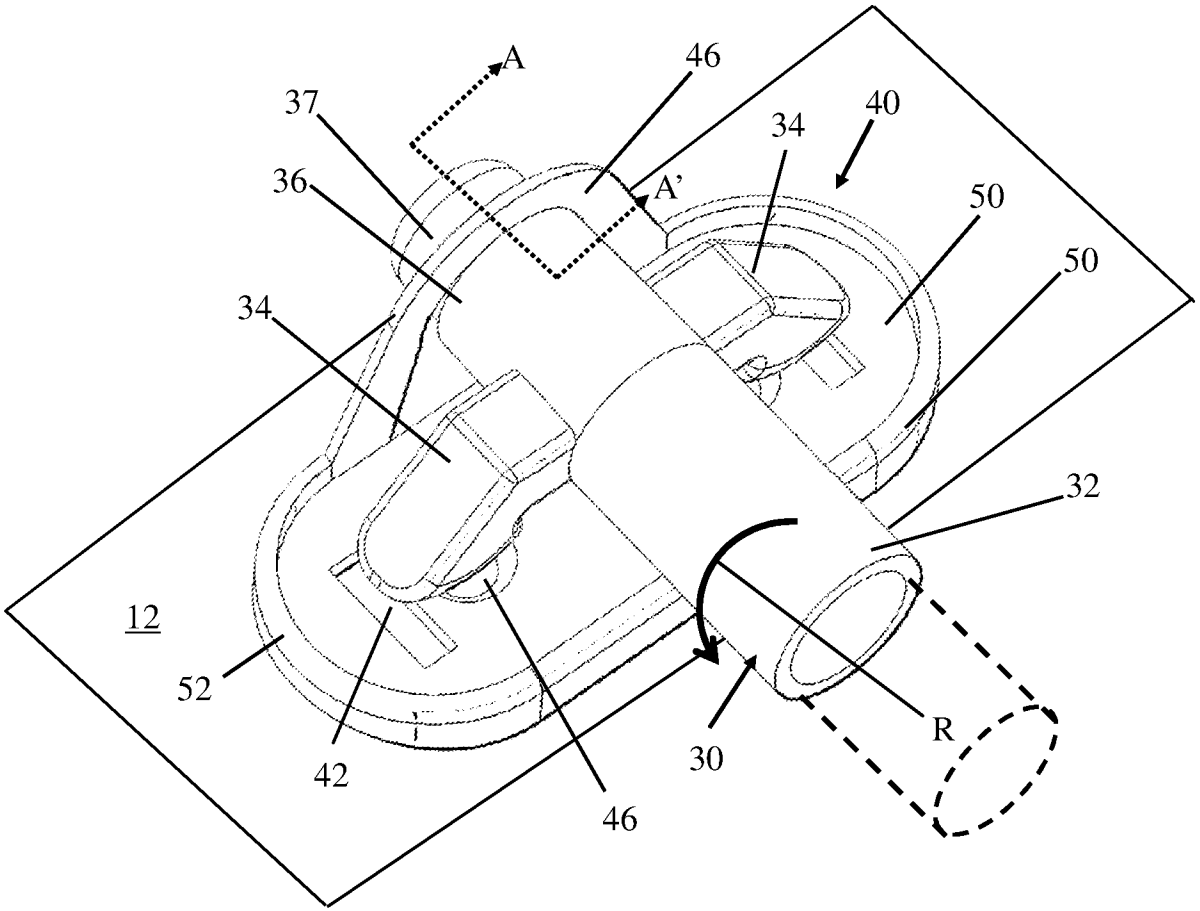
FIG. 11 shows a perspective view of a switching tool rotatably engaged to a retention device according to embodiments of the present disclosure.
Figure 12:
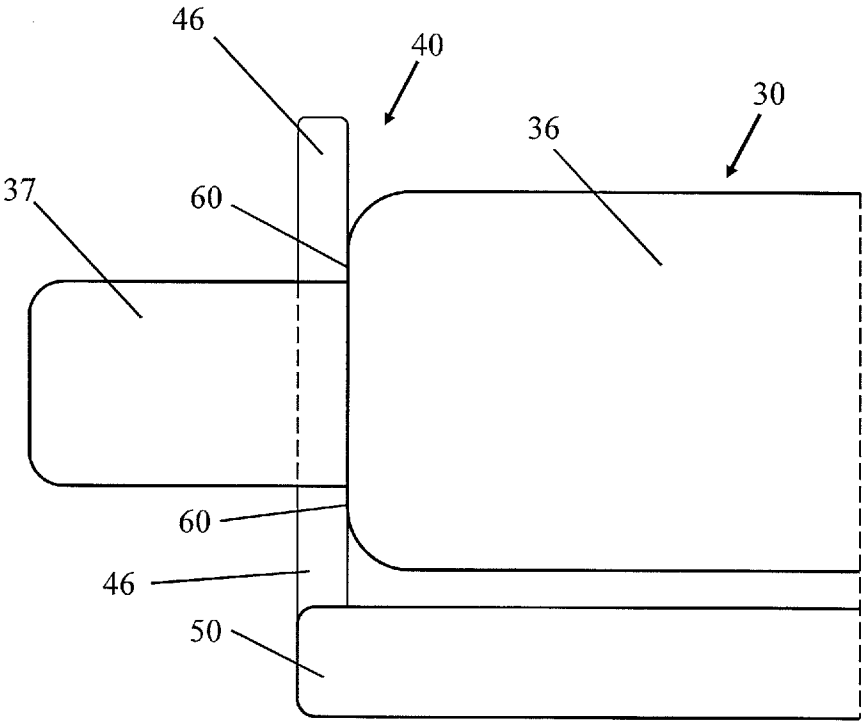
FIG. 12 shows a partial cross-sectional view of a switching tool rotatably engaged to a retention device according to embodiments of the present disclosure.

Turning to FIG. 11, switching tool 30 is shown engaging retention device 40 to better illustrate the operational characteristics and alignment features of retention device 40. FIG. 12 depicts a cross-sectional view of retaining member 37 of switching tool 30 and seat 46 of retention device 40 along line A-A' of FIG. 11. In an embodiment, retaining member 37 can be slidably inserted through seat 46, and rocking member 36 may include an axial stop 60 at its end shaped to axially engage seat 46. Mechanical engagement between axial stop 60 and can inhibit further translational movement of switching tool 30 in one direction, relative to retaining device 40. While axial stop 60 of switching tool 30 engages seat 46, rocking member 36 can be free to rotate relative to retention device 40, thereby allowing selective engagement of magnet(s) 34 (FIGS. 4-8) with magnetically actuated switches 24 (FIGS. 2-6) as described herein. A user can remove retaining member 37 from seat 46, e.g., by axially withdrawing switching device 30 to bring axial stop 60 out of contact with seat 46. It is also understood that various conventional forms of mechanical engagement between two or more elements can additionally or alternatively be used to temporarily engage switching device 30 with retention device 40, while permitting rotation of rocking member 36.

Embodiments of the present disclosure can provide several technical and commercial advantages, some of which are discussed by way of example herein. Systems which include switching apparatuses and/or switching tools according to the present disclosure can improve the use of window shade powered adjustment systems, such as those including electric motors. Many of these systems may be configured for use with conventional switching tools, such as static rods or wands. Embodiments of the present disclosure can also provide improved operability by allowing a user to effectuate multiple functions without physically contacting a housing with a switching tool, thereby reducing the difficulty in reaching switches in elevated windows, or improving ease of use by smaller-stature and/or handicapped users. Embodiments of the present disclosure thereby facilitate distal operation of powered window shading systems by a user, and without requiring a user to press a switch or similar instrument with his/her hand. In addition, embodiments of the present disclosure provide implements for enabling switching tools to readily, easily and reliably operate window shadings which feature a powered adjustment system.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A switching apparatus for a powered adjustment system of a window shading, wherein said switching apparatus comprises:

a magnetically actuated switch positioned externally to the powered adjustment system and having an on position and an off position, wherein said magnetically actuated switch actuates a drive mechanism of the powered adjustment system in the on position, the drive mechanism being configured to adjust a position of the window shading, wherein the magnetically actuated switch operates independently of the window shading; and an alignment feature positioned on a housing for the window shading proximal to said magnetically actuated switch, said alignment feature being configured to position a switching tool outside the housing to control the powered adjustment system by actuating said magnetically actuated switch between the on position and the off position.

2. The switching apparatus of claim 1, wherein said alignment feature comprises a visual indicator positioned on an exterior surface of the housing for identifying the position at which a magnet of the switching tool actuates said magnetically actuated switch between the off position and the on position.

3. The switching apparatus of claim 1, wherein said magnetically actuated switch includes a plurality of magnetically actuated switches operatively coupled to the drive mechanism, each of said plurality of magnetically actuated switches being configured to enable one of a plurality of operations of the drive mechanism in the powered adjustment system.

4. The switching apparatus of claim 3, wherein the plurality of operations includes lowering the window shading with the drive mechanism, raising the window shading with the drive mechanism, defining a memorized position of the window shading, and moving the window shading to the memorized position with the drive mechanism.

5. The switching apparatus of claim 1, wherein said alignment feature is further configured to position the switching tool to control the powered adjustment system without the switching tool contacting said magnetically actuated switch.

6. The switching apparatus of claim 1, wherein the housing is free of apertures extending between a hollow interior and an exterior surface of the housing, and wherein a material composition of the housing permits passage of magnetic flux therethrough.

7. The switching apparatus of claim 1, further comprising a retention device on the housing for coupling a portion of the switching tool to an exterior surface of the housing.

8. A window shading system comprising:

a housing assembly;

a rotatable member positioned within the housing assembly;

a shading element structurally independent of the housing assembly and mechanically coupled to said rotatable member, such that rotation of said rotatable member adjusts a position of said shading element relative to an architectural opening;

a powered adjustment system mechanically coupled to the housing assembly, said powered adjustment system including a drive mechanism configured to adjust the position of said shading element;

a magnetically actuated switch positioned externally to said powered adjustment system and operatively coupled thereto, said magnetically actuated switch having an on position and an off position, such that said magnetically actuated switch selectively enables operation of said drive mechanism, wherein operation of the magnetically actuated switch is independent of the window shading; and an alignment feature positioned on the housing assembly for the window shading proximal to said magnetically actuated switch, said alignment feature being configured to position a switching tool outside the housing assembly to control the powered adjustment system by actuating said magnetically actuated switch between the on position and the off position.

9. The window shading system of claim 8, wherein said alignment feature comprises a visual indicator positioned on an exterior surface of the housing assembly for identifying the position at which a magnet of the switching tool actuates said magnetically actuated switch between the off position and the on position.

10. The window shading system of claim 8, wherein said alignment feature is further configured to position the switching tool to control the powered adjustment system without the switching tool contacting said magnetically actuated switch.

11. The window shading system of claim 8, wherein said magnetically actuated switch includes a plurality of magnetically actuated switches operatively coupled to the drive mechanism, each of said plurality of magnetically actuated switches being configured to enable one of a plurality of operations of said drive mechanism in said powered adjustment system.

12. The window shading system of claim 11, wherein the plurality of operations includes lowering the window shading with said drive mechanism, raising the window shading with said drive mechanism, defining a memorized position of the window shading, and moving the window shading to the memorized position with said drive mechanism.

13. The window shading system of claim 8, further comprising a retention device on the housing assembly for coupling a portion of the switching tool to the exterior surface of the housing assembly.

14. The window shading system of claim 8, wherein the magnetically actuated switch comprises a reed switch having a magnetic metal therein.

15. A system comprising:

a rotatable member positioned within a housing;

a shading element mechanically coupled to said rotatable member such that rotation of said rotatable member adjusts a position of said shading element relative to an architectural opening;

a drive mechanism mechanically coupled to said rotatable member to drive rotation thereof;

a switch positioned externally to said drive mechanism and operably coupled thereto, wherein said switch being actuated to an on position enables operation of said drive mechanism, and wherein a cover visually conceals a position of said switch;

an alignment feature positioned on the cover and proximal to said switch; and a switching tool having a magnet configured to actuate said actuated switch between the on position and the off position without contacting said switch, wherein the switching tool is independent of the shading element and the housing.

16. The system of claim 15, wherein said switch comprises a reed switch having a magnetic metal therein.

17. The system of claim 16, wherein the housing is free of apertures extending between a hollow interior and an exterior surface of the housing, and wherein a material composition of the housing permits passage of magnetic flux therethrough.

18. The system of claim 15, wherein said switch includes a plurality of switches positioned externally to said drive mechanism and operably coupled to said drive mechanism, each of said plurality of switches being configured to enable one of a plurality of operations of said drive mechanism.

19. The system of claim 18, wherein the plurality of operations includes lowering said shading element with said drive mechanism, raising said shading element with said drive mechanism, defining a memorized position of said shading element, and moving said shading element to the memorized position with said drive mechanism.

20. The system of claim 15, further comprising a retention device on the housing for coupling a portion of a switching tool to the housing proximal to said switch.

* * * * *